United States Patent [19]

Foster

[11] 4,059,201

[45] Nov. 22, 1977

[54] CONTAINER CLOSURE WITH FOIL SEAL

[75] Inventor: John A. Foster, Rockford, Ill.

[73] Assignee: J. L. Clark Manufacturing Co., Rockford, Ill.

[21] Appl. No.: 777,068

[22] Filed: Mar. 14, 1977

[51] Int. Cl.[2] ..... B65D 51/22

[52] U.S. Cl. ..... 220/258; 220/267; 220/339; 222/83; 222/541; 220/259

[58] Field of Search ..... 220/258, 267, 259, 270, 220/339; 222/83, 541; 229/7 R

[56] References Cited

U.S. PATENT DOCUMENTS

| | | | |
|---|---|---|---|
| 3,833,144 | 9/1974 | Bollmann et al. | 220/267 |
| 3,912,128 | 10/1975 | Ziemann et al. | 222/541 |

*Primary Examiner*—George T. Hall

*Attorney, Agent, or Firm*—Leydig, Voit, Osann, Mayer & Holt, Ltd.

[57] ABSTRACT

The dispensing opening of a container closure is originally sealed with foil which may be torn out of the opening by a hinged door located removably in the opening.

15 Claims, 9 Drawing Figures

CONTAINER CLOSURE WITH FOIL SEAL

BACKGROUND OF THE INVENTION

This invention relates to a closure for a container and, more particularly, to a closure having a dispensing opening which is originally covered and sealed by a tearable film such as paper or foil. The contents of the container may be dispensed through the opening after the film has been torn out of the opening.

SUMMARY OF THE INVENTION

The general aim of the present invention is to provide a new and improved container closure of the above type which enables the film to be torn from the dispensing opening in a quicker and easier manner than has been possible heretofore and which, at the same time, enables removal of virtually all of the film from around the margins of the opening so that the latter will be completely exposed and will not be significantly obstructed by the torn edges of the film which remains attached to the closure.

A more detailed object is to achieve the foregoing by providing a closure having a detachable door which is swingably mounted within the opening and which is located above the film. A first section of the door is sealed to the underlying portion of film and, when downward finger pressure is exerted on the first section, the latter swings downwardly and first punctures the film and then tears the underlying film portion away from the opening. As the first door section swings downwardly, a second door section — which is not sealed to the underlying portion of film — swings upwardly and defines a finger grip which may be pulled to enable the door to be broken away from and removed out of the opening. As the door is removed from the opening, the film which is attached to the first door section causes the remaining film in the opening to be torn away from the edges thereof so as to leave the opening almost completely exposed.

The invention also resides in the provision of a unique prong which is swingably mounted on the first door section and which serves to puncture the film and reduce its resistance to tearing when downward finger pressure is first applied to the first door section, the prong being positioned so as to not interfere with sealing of the first door section to the underlying film.

Another object of the invention is to provide a closure of the foregoing type having a flap which enables the dispensing opening to be re-closed after the film has been torn from the opening, the flap also facilitating sealing of the first door section to the underlying film.

These and other objects and advantages of the invention will become more apparent from the following detailed description when taken in conjunction with the accompanying drawings.

DETAILED DESCRIPTION OF THE PREFERRED EMBODIMENT

Figure 1:
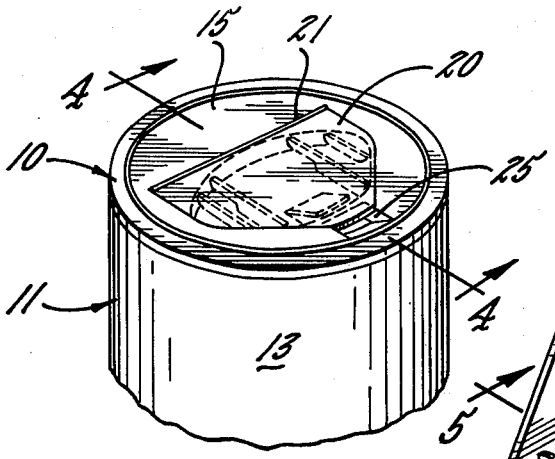
FIG. 1 is a fragmentary perspective view of a container equipped with a new and improved closure incorporating the unique features of the present invention, the flap of the closure being shown in a closed position.

As shown in the drawings for purposes of illustration, the invention is embodied in a closure 10 for a container 11 adapted to hold a food product such as croutons or the like. The container is of conventional construction and includes a cylindrical body 13 (FIG. 4) having an open upper end. The body may be made of paperboard and may be lined on its inner side with a layer 14 of metallic foil which acts as a moisture barrier to help preserve the freshness of the product.

The closure 10 comprises a cover defined by a generally horizontal top wall 15 of circular shape and molded from suitable plastic. A skirt 16 (FIG. 4) is molded integrally with and depends from the top wall adjacent the periphery thereof and is telescoped snugly into the upper end portion of the container 11.

Formed through the central portion of the top wall 15 is a dispensing opening 17 (FIG. 2) which may be of any desired shape. The peripheral wall of the opening is defined by a depending rib 19 (FIG. 4) which is molded integrally with the underside of the top wall, the lower edge of the rib being disposed in substantially the same plane as the lower edge of the skirt 16.

Figure 5:
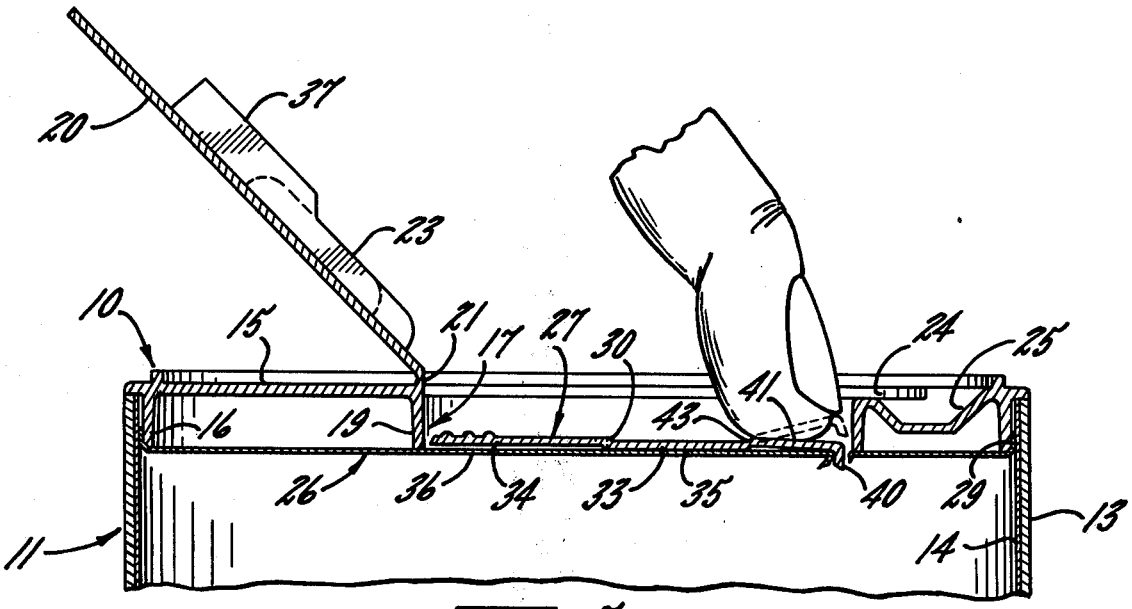
FIG. 5 is an enlarged fragmentary cross-section taken substantially along the line 5—5 of FIG. 2 and shows the film being punctured.

The upper side of the dispensing opening 17 is adapted to be closed by a flap 20 molded integrally with the upper side of the top wall 15 and hinged to the latter as indicated at 21 (FIGS. 1 and 5) to enable the flap to swing upwardly and downwardly between closed and opened positions. Four depending ribs 23 (FIG. 2) are molded integrally with the underside of the flap to impart rigidity to the flap.

Figure 2:
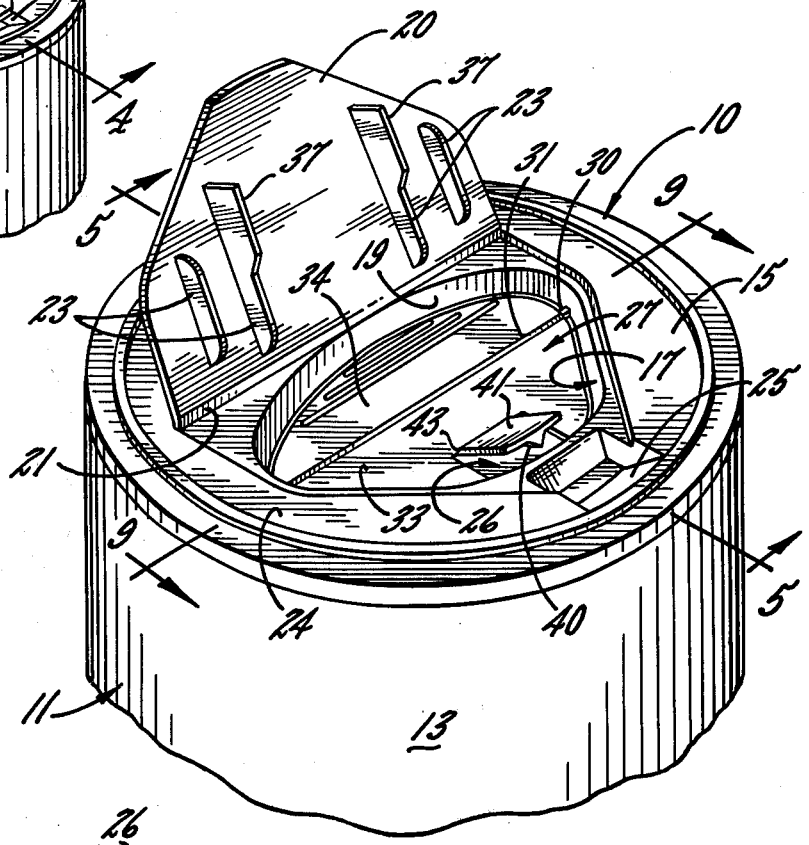
FIG. 2 is an enlarged view similar to FIG. 1 but shows the flap in an open position and shows the door located within the opening prior to tearing of the film.

A portion of the top wall 15 is recessed as indicated at 24 in FIG. 2 to receive the flap 20 and thus enable the upper side of the flap to be located flush with the upper side of the top wall when the flap is in its closed position. Coacting means (not shown) may be formed on the edge of the flap 20 and the edge of the recess 24 to hold the flap releasably in its closed position with a snap fit. Also, a depression 25 is formed in the top wall adjacent the free edge of the flap to facilitate initial lifting of the latter by means of an index finger inserted into the depression.

Figure 4:
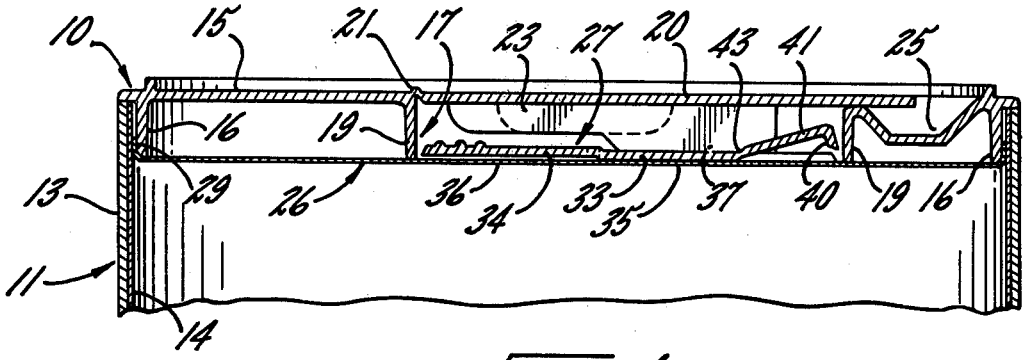
FIG. 4 is an enlarged fragmentary cross-section taken substantially along the line 4—4 of FIG. 1.

As shown most clearly in FIG. 4, the lower side of the dispensing opening 17 is originally sealed by a film 26 — preferably a metallic foil— which prevents insects, worms and dirt from entering the container 11 through the opening and which also serves as a moisture barrier prior to the time the container is initially opened. In accordance with the present invention, a unique door 27 is swingably mounted within the opening 17 just above the foil 26 and enables the foil to be torn out of the opening very quickly and easily. In addition, the door effects removal of virtually all of the foil from the opening so that little if any foil is left in obstructing relation to the opening.

More specifically, the foil 26 is sealed to the lower edge of the rib 19 around the full periphery thereof so that the dispensing opening 17 is completely sealed around its entire margin. The foil preferably extends outwardly beyond the opening and beneath the skirt 16 (see FIG. 4) and is sealed to the lower edge of the skirt. Also, the marginal portions 29 of the foil are folded upwardly around and are sealed to the outer side of the skirt and are disposed in snug contact with the foil liner 14 of the container 11.

Figure 9:
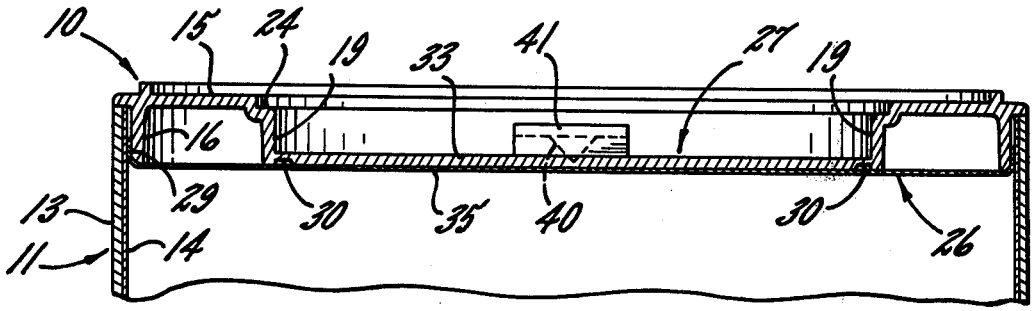
FIG. 9 is an enlarged fragmentary cross-section taken substantially along the line 9—9 of FIG. 2.

The door 27 is located within the opening 17 in a position just above the foil 26 and comprises a relatively thin piece of plastic having a peripheral size and shape similar to the size and shape of the opening. In carrying out the invention, two alined pivots 30 (FIGS. 2 and 9) connect the door to the rib 19 and support the door for vertical swinging about a horizontal axis 31 (FIG. 2) extending between the pivots and located about midway between the front and rear of the opening 17. Herein, each pivot is in the form of a very short and thin web or pintle which is molded integrally with and which extends between the rib 19 and the edge of the door 27. Because of their thinness, the pintles 30 are flexible, and when downward finger pressure is applied to the door, the pintles twist along their length to enable the door to swing vertically while still keeping the door attached to the rib 19.

It should be noted here that the pivot axis 31 which extends between the pintles 30 defines an imaginary line which divides the door 27 into a front section 33 and a rear section 34. When the foil 26 is torn from the opening 17, downward finger pressure is applied to the front or free edge portion of the front door section 33 and thus that section swings downwardly about the axis 31 while the rear door section 34 simultaneously swings upwardly about the axis.

Further in keeping with the invention, that portion 35 (FIG. 4) of the foil 26 that underlies the front door section 33 is sealed to the lower side of the front section and remains attached to that section when the foil is torn from the opening 17. The rear door section 34, however, is not sealed to the underlying foil portion 36 and thus is free to swing upwardly when the front door section is swung downwardly.

The foil 26 may be sealed to the skirt 16, to the lower edge of the rib 19 and to the lower side of the front door section 33 with various types of cements. Alternatively, the upper side of the foil may be coated with a heat sealable material which adheres to plastic when heat and pressure are applied to the lower side of the foil. To facilitate sealing of the foil, the lower side of the front door section 33 is located in the same horizontal plane as the lower edges of the skirt 16 and the rib 19 and thus all of the downwardly facing surfaces to which the foil is sealed define a coplanar back-up for a pressure shoe or sealing die. Accordingly, the foil 26 may be stretched tightly across the opening 17 and may be joined to the skirt, the rib and the front door section with a good seal.

To prevent the front door section 33 from swinging upwardly when sealing pressure is applied to the underside of the front door section, downwardly extending projections 37 (FIG. 2) are formed on two of the ribs 23 on the flap 20. The sealing operation is performed while the flap is in its closed position and, when the flap is closed, the projections 37 engage and back the upper side of the front door section 33 as shown in FIG. 4 to prevent upward swinging of the front door section.

In order to insure that the foil 26 will not be sealed to the rear door section 34, the lower side of that door section is spaced upwardly from the lower side of the front door section 33 as shown in FIG. 4. Accordingly, the upper side of the foil is kept out of engagement with the rear door section during the sealing operation.

Means 40 are provided for puncturing a small hole in the front foil portion 35 just prior to the time the front door section 33 is swung downwardly to tear the foil 26. The hole reduces the resistance of the foil portion 35 to tearing and enables that foil portion to be easily torn from the opening 17 by the front door section when the latter is swung downwardly.

Herein, the puncturing means 40 take the form of a small depending prong which is located immediately adjacent the extreme forward edge of the front door section 33. The prong 40 preferably is located along a line which extends perpendicular to and bisects the axis 31 so that the prong is centered with respect to the pintles 30. Also, the prong preferably is molded on the forward edge of a small tab 41 which is located within the confines of the front door section 33 but which is connected to the latter only along an axis or hinge line 43 extending parallel to the axis 31. The tab 41 is molded integrally with the front door section 33 and, as molded, is inclined upwardly and forwardly from the front door section as shown in FIG. 4. As a result of such inclination, the prong 40 is spaced upwardly from the foil 26 and will not puncture the foil either during the sealing operation or in the event that the container 11 is turned upside down to cause its contents to press against the foil. Also, the tab 41 allows the prong 40 to swing downwardly and puncture the foil before the front door section 33 is swung downwardly to tear the foil.

Figure 6:
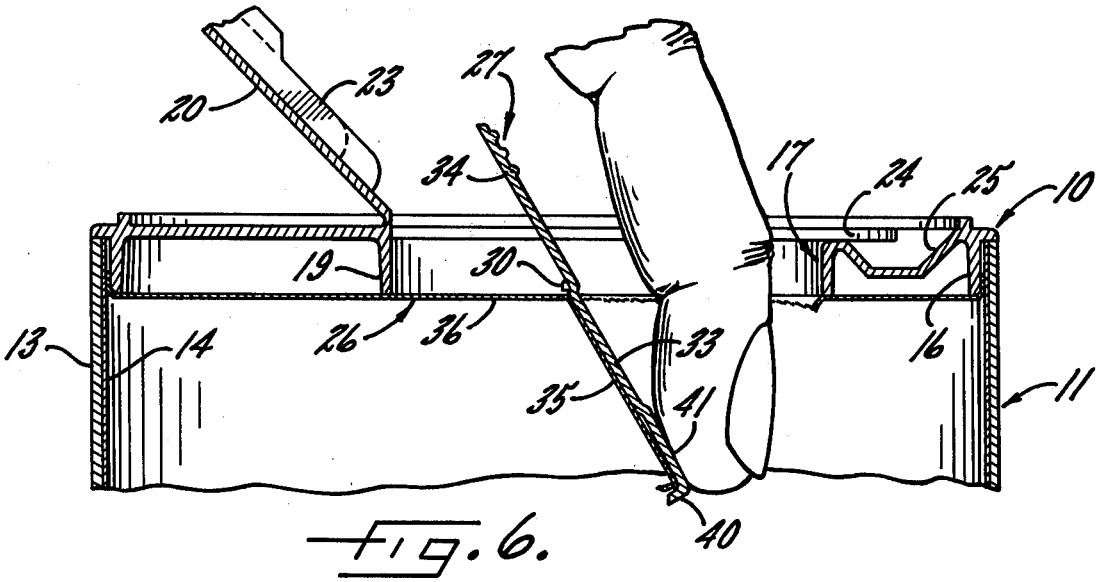
FIGS. 6, 7 and 8 are views similar to FIG. 5 and show the successive steps which occur as the film is torn out of the opening and as the door is removed from the opening.

To open the container 11, the flap 20 first is swung upwardly to its open position to expose the door 27 as shown in FIG. 2. Then, the user presses downwardly on the tab 41 with his index finger to cause the tab to swing downwardly about the hinge 43 and to cause the prong 40 to puncture a small hole in the foil portion 35 (see FIG. 5). With the foil 26 being punctured, the resistance of the foil to tearing is significantly reduced. Accordingly, the foil portion 35 tears very easily and tears away from the lower edge of the front portion of the rib 19 as the user continues to apply downward finger pressure to the tab to swing the front door section 33 downwardly to the position shown in FIG. 6.

Figure 3:
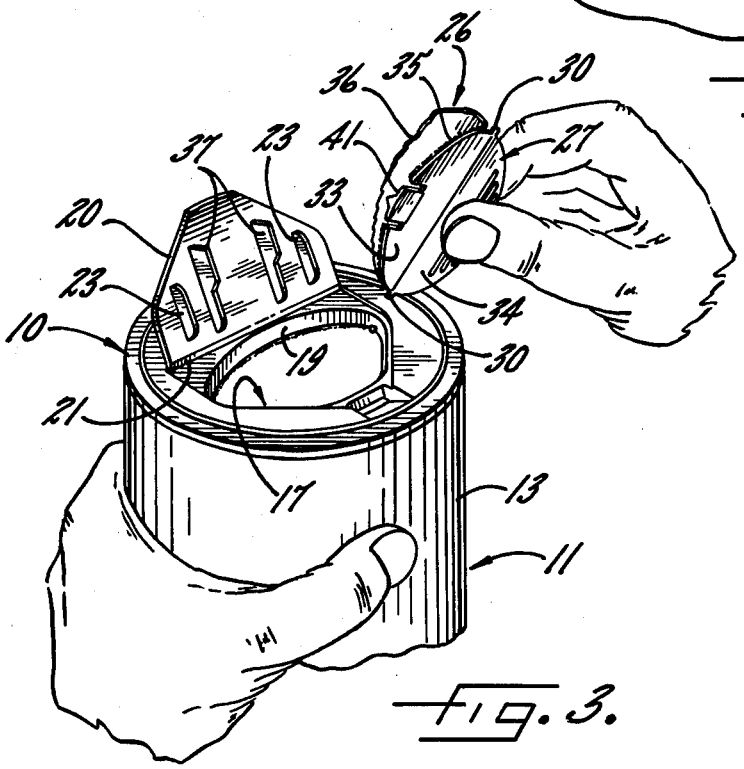
FIG. 3 is a view similar to FIG. 2 but shows the closure after the film has been torn and after the door has been removed from the opening.
Figure 7:
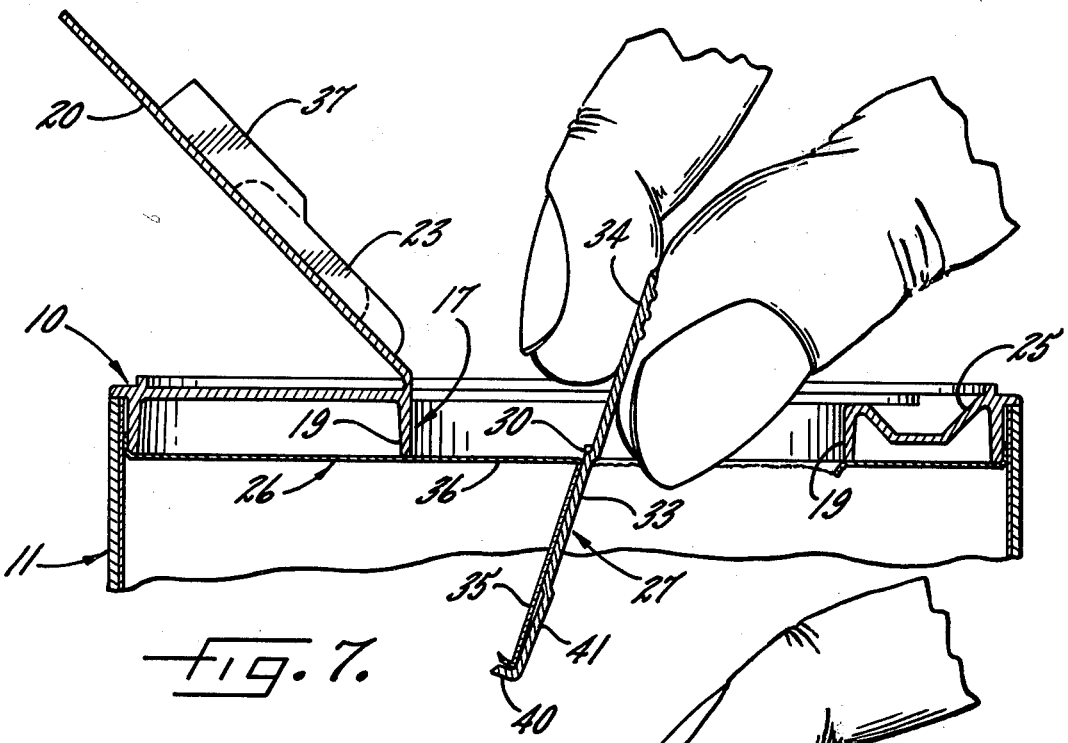
Figure 8:
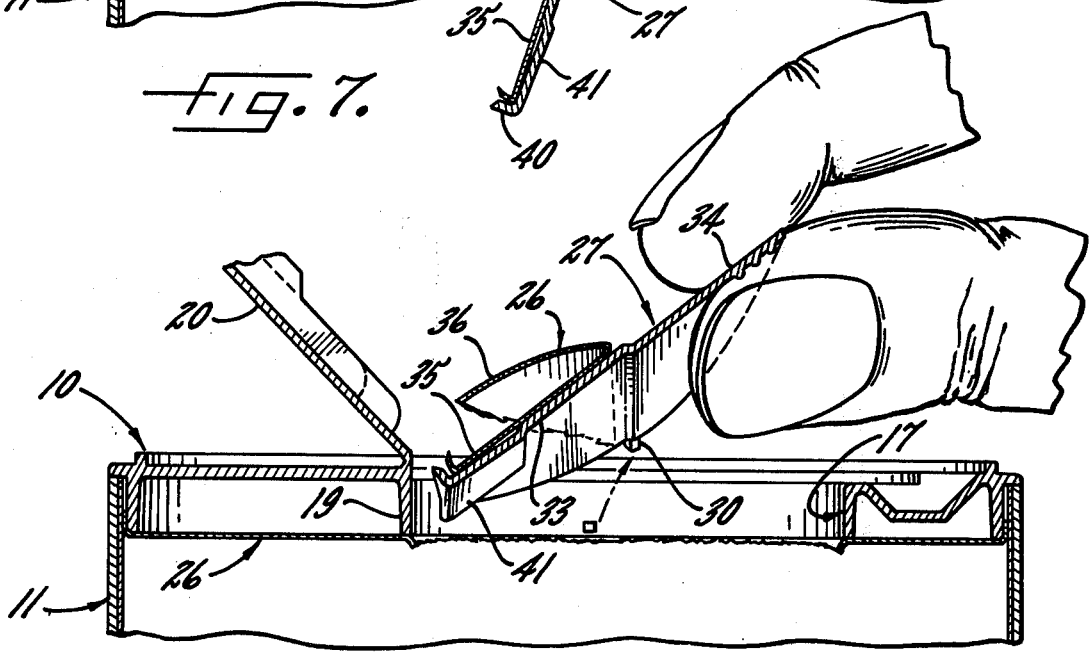

As the front door section 33 is swung downwardly, the rear door section 34 swings upwardly and defines a finger grip which the user may hold between his thumb and index finger as shown in FIG. 7. With the rear door section thus held, the user pulls upwardly on the door 27 to break the thin pintles 30 and thus enable the door to be pulled upwardly out of the opening 17. Because the front foil portion 35 is sealed to the front door section 33, the front foil portion remains attached to the door as the latter is removed from the opening and, during such removal, the front foil portion pulls on the rear foil portion 36 and causes the rear foil portion to be torn away from the rib 19 and torn out of the rear portion of the opening 17 (see FIGS. 3 and 8). The door with the attached foil then may be discarded.

After being opened, the container 11 may be reclosed by swinging the flap 20 to its closed position. In addition to enabling reclosure of the container, the flap guards against the danger of the door 27 being swung vertically while the container is being shipped and displayed.

From the foregoing, it will be apparent that the present invention brings to the art an improved container closure 10 having a dispensing opening 17 which is effectively sealed with foil 26 or other film that may be easily torn from the opening as a result of the provision of the unique door 27 equipped with the puncturing prong 40. The door effects removal of virtually all of the foil from the opening and leaves very little foil remaining obstructing the margins of the opening.

I claim:

1. A container closure comprising a cover having a dispensing opening extending vertically therethrough, a tearable film covering the lower side of said opening and sealed to said cover, a generally horizontal door located within said opening and positioned above said film, said door having first and second sections with at least said first door section corresponding substantially in shape to the shape of that portion of the opening within which said first door section is located, two pivots made of breakable material and alined with one another along an axis defining the dividing line between said first and second door sections, said pivots connecting said door to the wall of said opening and permitting said door to swing vertically within said opening, said film having a first portion which underlies and is sealed to the first door section and having a second portion which underlies and is free of said door section, and means depending from said first door section for puncturing a hole in said first film portion when finger pressure is initially applied to said first door section in a direction to swing the latter downwardly whereby such downward swinging causes said first door section to tear the punctured first film portion away from the margins of said opening, said second door section swinging upwardly as said first door section swings downwardly and defining a finger grip which may be held and pulled upwardly to break said pivots and enable removal of said door from said opening, said first film portion remaining sealed to said first door section and causing said second film portion to tear away from the margins of said opening as said door is removed from said opening.

2. A container closure as defined in claim 1 in which said cover comprises a top wall, the wall of said opening being defined by a rib depending from said top wall, said film being sealed to the lower edge of said rib.

3. A container closure as defined in claim 2 in which the lower side of said first door section is disposed substantially in the same plane as the lower edge of said rib while the lower side of said second door section is located above said plane and is spaced above said second film portion.

4. A container closure as defined in claim 2 further including a skirt depending from the periphery of said top wall and adapted to telescope into a container, said film also being sealed to said skirt.

5. A container closure as defined in claim 4 in which the margins of said film are folded upwardly around the outer side of said skirt and are sealed to such outer side.

6. A container closure as defined in claim 1 in which said cover and said door are molded of plastic, each of said pivots being defined by a thin pintle molded integrally with and extending between one edge of said door and the wall of said opening.

7. A container closure as defined in claim 1 in which said means comprise a downwardly projecting prong.

8. A container closure as defined in claim 7 in which said prong lies on a line which substantially bisects said axis and which extends substantially perpendicular to said axis.

9. A container closure as defined in claim 7 in which said door is molded of plastic, a tab molded integrally with said first door section and hinged to the latter to swing downwardly about an axis extending substantially parallel to said one axis, said prong being molded integrally with and depending from the underside of said tab.

10. A container closure as defined in claim 9 in which said tab normally is disposed in an upwardly inclined position relative to said first door section in order to normally keep the lower end of said prong spaced above said first film portion.

11. A container closure as defined in claim 1 further including a flap hinged to the upper side of said cover and swingable between positions opening and closing the upper side of said opening.

12. A container closure as defined in claim 11 further including means depending from the lower side of said flap and engaging the upper side of said door when said flap is closed.

13. A container closure comprising a top wall having a dispensing opening extending therethrough, a flap hinged to said wall and swingable between positions opening and closing the upper side of said opening, a tearable film covering the lower side of said opening and sealed to the lower margins of said opening, a door located within said opening and positioned above said film, said door substantially corresponding in shape to the shape of said opening and having first and second sections, two pivots made of breakable material and alined with one another along an axis defining the dividing line between said first and second door sections, said pivots connecting said door to the wall of said opening and permitting said door to swing vertically within said opening, said film having a first portion which underlies and is sealed to the first door section and having a second portion which underlies and is free of the second door section, and means depending from said first door section for puncturing a hole in said first film portion when finger pressure is initially applied to said first door section in a direction to swing the latter downwardly whereby such downward swinging causes said first door section to tear the punctured first film portion away from the margins of said opening, said second door section swinging upwardly as said first door section swings downwardly and defining a finger grip which may be held and pulled upwardly to break said pivots and enable removal of said door from said opening, said first film portion remaining sealed to said first door section and causing said second film portion to tear away from the margins of said opening as said door is removed from said opening.

14. A container closure comprising a cover having a top wall molded of plastic, a dispensing opening extending vertically through said top wall and having a substantially vertical wall defined by a rib molded integrally with and depending from said top wall, a flap hinged to said top wall and swingable between positions opening and closing the upper side of said opening, a tearable film covering the lower side of said opening and sealed to the lower edge of said rib around the entire perimeter of said opening, a door molded of plastic and located within said opening and above said film, said door having first and second sections with at least said first door section corresponding substantially in shape to the shape of that portion of the opening within which said first door section is located, two pintles molded integrally with and extending between said rib and the edge of said door and alined with one another along an axis defining the dividing line between said first and second door sections, said pintles being breakable and connecting said door to said rib for vertical swinging of said door within said opening, said film having a first portion which underlies and is sealed to said first door section and having a second portion which underlies and is free of said second door section, a tab molded integrally with said first door section adjacent the free edge thereof and hinged to said first door section to swing downwardly relative to the latter about an axis extending substantially parallel to said one axis, a prong molded integrally with and depending from said tab and being located on a line which substantially bisects said one axis and which extends substantially perpendicular to said one axis, said prong puncturing a hole in said first film portion when said tab is swung downwardly relative to said first door section whereby said first door section thereafter may be swung downwardly to tear the punctured first film portion away from the lower edge of said rib, said second door section swinging upwardly as said first door section swings downwardly and defining a finger grip which may be held and pulled upwardly to break said pintles and enable removal of said door from said opening, said first film portion remaining sealed to said first door section and causing said second film portion to tear away from the lower edge of said rib as said door is removed from said opening.

15. A container closure as defined in claim 14 in which the lower side of said first door section is disposed substantially in the same plane as the lower edge of said rib while the lower side of said second door section is located above said plane and is spaced above said second film portion, said tab normally being disposed in an upwardly inclined position relative to said first door section in order to keep the lower end of said prong spaced above said first film portion.

* * * * *